US006827834B2

(12) United States Patent
Stewart et al.

(10) Patent No.: US 6,827,834 B2
(45) Date of Patent: Dec. 7, 2004

(54) NON-CYANIDE COPPER PLATING PROCESS FOR ZINC AND ZINC ALLOYS

(76) Inventors: Ronald Stewart, 4807 Beech Knoll Ct., Charlotte, NC (US) 28212-4424; Carl Steinecker, 12423 Sunview Ct., South Lyon, MI (US) 48178

( * ) Notice: Subject to any disclaimer, the term of this patent is extended or adjusted under 35 U.S.C. 154(b) by 0 days.

(21) Appl. No.: 10/096,411

(22) Filed: Mar. 12, 2002

(65) Prior Publication Data

US 2003/0183532 A1 Oct. 2, 2003

(51) Int. Cl.[7] ..... C23C 28/02; C25D 5/00
(52) U.S. Cl. ..... 205/184; 205/187; 205/143
(58) Field of Search ..... 205/184, 185, 205/187, 215, 143

(56) References Cited

U.S. PATENT DOCUMENTS

| | | | | |
|---|---|---|---|---|
| 4,273,837 A | | 6/1981 | Coll-Palagos | 428/647 |
| 4,599,279 A | | 7/1986 | Mirra et al. | 428/658 |
| 6,007,758 A | | 12/1999 | Fleming et al. | 264/429 |
| 6,054,037 A | | 4/2000 | Martin | 205/295 |
| 6,068,938 A | | 5/2000 | Kato et al. | 428/649 |
| 6,099,991 A | * | 8/2000 | Inagaki et al. | 429/235 |
| 6,178,623 B1 | * | 1/2001 | Kitazawa et al. | 29/825 |
| 2002/0100694 A1 | * | 8/2002 | Morin et al. | 205/170 |

OTHER PUBLICATIONS

Lowenheim, "Electroplating", pp. 203–204, © (month unavailable) 1978.*

* cited by examiner

*Primary Examiner*—Edna Wong
(74) *Attorney, Agent, or Firm*—Carmody & Torrance LLP

(57) ABSTRACT

The invention consists of a method for producing an adherent copper coating on a zinc or zinc alloy article without the use of cyanide as a component of the process. The zinc or zinc alloy article is first immersed in an aqueous nickel pyrophosphate solution and is then electroplated with a copper pyrophosphate solution. The method produces an adherent copper coating on the zinc or zinc alloy, which can be deformed without any loss of the copper coating.

22 Claims, No Drawings

NON-CYANIDE COPPER PLATING PROCESS FOR ZINC AND ZINC ALLOYS

FIELD OF THE INVENTION

The present invention is directed to a method for producing an adherent copper coating on a zinc or zinc alloy article without the use of cyanide as a complexor in the copper plating bath.

BACKGROUND OF THE INVENTION

Zinc and zinc alloy products are generally produced as zinc die castings or formed from sheet using rolled zinc alloys. To enhance the decorative features of articles made from zinc alloys and to enhance the corrosion resistance properties of such articles, it is common in the industry to coat zinc or zinc alloy articles with other metals. This coating is generally accomplished by electroplating metals, such as copper, nickel, chromium, tin, and brass, onto the surface of the zinc or zinc alloy product. Copper coated zinc alloy is advantageously employed to produce various cast, extruded, molded articles, and the like, including trims, fixtures, and coin blanks, such as zinc alloy (2% copper) penny blanks.

Zinc and zinc alloy articles have traditionally been electroplated with copper using cyanide as a component of the copper electroplating process. Because of the toxicity of cyanide, efforts have been made to replace the copper cyanide plating solutions with other plating solutions that do not contain cyanide.

There are three general types of copper plating processes that are currently used. The first process is a cyanide or non-cyanide alkaline bath, which may contain cyanide or not. A second type of process uses an acid bath, and contains sulfate, or alternatively, fluoborate, as a complexor. The third type of process is a mildly alkaline pyrophosphate complexed bath.

While it would be desirable to use copper pyrophosphate plating baths in place of the more toxic cyanide plating baths for electroplating on zinc and zinc alloys, prior efforts to this regard have produced non-functional loosely adherent immersion copper deposits.

Copper pyrophosphate electroplating baths have been used, for example, in metallizing magnetic ceramic materials, such as inductors and transformers. U.S. Pat. No. 6,007,758, to Fleming et al., which is hereby incorporated by reference, discloses electroplating copper pyrophosphate onto a conductive material. The reference teaches that the conductive material, which is applied as a conductive ink, contains silver/palladium particles. Copper is electroplated on to the conductive material using a copper pyrophosphate bath, to produce an adherent copper layer on the surface.

U.S. Pat. No. 6,068,938, to Kato et al., which is hereby incorporated by reference, discloses coating a magnesium based article by a zinc immersion coating, wherein the zinc layer has an underlayer of copper plating formed using a copper pyrophosphate solution. This patent indicates that in a conventional zinc immersion process, copper pyrophosphate is not used because a zinc layer with a "defective portion" is produced, which exerts a wrong influence of plate adhesion. In addition, the invention disclosed by this patent does not contemplate plating a zinc or zinc alloy article using a copper pyrophosphate solution.

U.S. Pat. No. 6,054,037, to Martin, which is hereby incorporated by reference, discloses a copper plating solution that does not contain cyanide. The plating solution is an organophosphanate base, cyanide-free copper electrolyte. However, this plating solution does not contain copper pyrophosphate. In addition, there is no indication as to the adherence of the copper plating on the zinc or zinc alloy article.

Therefore, a need exists in the art for a process that does not contain cyanide in the plating bath and that produces a strongly adherent copper coating on a zinc or zinc alloy article.

The present invention is directed to a method for producing an adherent copper coating on a zinc or zinc alloy article without the use of cyanide as a component of the plating process. The zinc or zinc alloy article is first immersed in an aqueous nickel pyrophosphate solution and is then electroplated with a copper pyrophosphate solution. Nickel pyrophosphate solutions have not previously been used to form a layer suitable for alkaline electroplating. The method produces an adherent copper coating on the zinc or zinc alloy, which coating can be deformed without any loss of the copper coating

SUMMARY OF THE INVENTION

It is an object of the present invention to produce an adherent copper coating on a zinc or zinc alloy without the use of cyanide as a complexor of the copper plating bath.

In accordance with the present invention, a method for copper plating a zinc or zinc alloy article is provided, wherein the method comprises the steps of:

a) cleaning and activating the zinc or zinc alloy article;

b) immersing the cleaned and activated zinc or zinc alloy article in an aqueous nickel solution, wherein the nickel solution comprises a source of nickel, a source of pyrophosphate, and a source of hydroxide; and c) electroplating the zinc or zinc article in a copper pyrophosphate solution to a desired thickness.

DETAILED DESCRIPTION OF THE INVENTION

This invention describes a method of treating zinc and zinc alloy articles to produce an adherent copper coating on the surface of the articles. In particular, this method may be used for coating zinc alloy (2% copper) penny blanks. At the present time, all penny blanks are plated with a cyanide copper plating solution.

The process of the invention generally includes the steps of:

a) optionally but preferably, cleaning and activating the zinc or zinc alloy article;

b) immersing the cleaned and activated zinc or zinc alloy article in an aqueous nickel solution, wherein the nickel solution comprises a source of nickel, a source of pyrophosphate, and a source of hydroxide; and c) electroplating the zinc or zinc alloy article in a copper pyrophosphate solution to a desired thickness.

The cleaning and activating step is preferred to provide a surface of the article that is suitable for plating. Defects such as lack of adhesion, porosity, roughness, dark spots, and non-uniform coatings are likely to occur on poorly prepared parts. The surface preparation process also serves to activate the surface of the part so that it is optimally receptive to the deposition of the metal coating.

The zinc or zinc alloy articles are first cleaned in a standard alkaline cleaning solution. The articles are then activated by a short immersion dip in an acid solution, such as a 10% aqueous solution of sulfuric acid. Thorough rinsing is required between cleaning stages and prior to plating to remove all traces of alkali and acid from porous areas on the surface of the parts.

After the cleaning and activating step, the zinc or zinc alloy article is treated in an aqueous solution containing nickel and a complexor, preferably a salt of pyrophosphate, at an alkaline pH, so that a firmly adherent, continuous nickel coating can be formed, by immersion plating, on the surface of the zinc or zinc alloy article.

Various sources of nickel may be used in the present invention. Of particular interest are nickel salts, such as nickel sulfamate, nickel sulfate, nickel pyrophosphate, and nickel chloride. The concentration of the nickel salt in the aqueous solution is generally between about 6 and about 20 grams/liter.

Although typical pyrophosphate nickel solutions contain ammonium ion, the inventors have found that a solution free of ammonium, but using an alkali metal salt may also be used. Accordingly, the pyrophosphate salt of the invention is selected from the group consisting of potassium pyrophosphate, sodium pyrophosphate, and ammonium pyrophosphate. The concentration of the pyrophosphate salt in the aqueous solution is generally between about 30 and about 60 grams/liter.

In addition to the nickel salt and pyrophosphate salt, the aqueous nickel solution contains a sufficient quantity of ammonium hydroxide, sodium hydroxide, or potassium hydroxide to raise the pH of the solution to between about 9 and 10.

The alkaline nickel plating solution is optimally maintained at a temperature between room temperature and about 80° C. The articles are generally immersed in the aqueous solution for a period of time ranging from about 2 minutes to about 20 minutes. The resultant immersion plating is continuous and adherent.

After the nickel plating process is completed, the articles are again rinsed. The resulting nickel coating is sufficiently noble and continuous so that an alkaline pyrophosphate copper plating solution can be used to electroplate a uniform adherent copper layer on the zinc or zinc alloy article. The articles are subjected to an electrolytic copper plating in a standard copper pyrophosphate plating solution until the desired thickness of copper on the surface of the articles has been reached.

Pyrophosphate copper baths are mildly alkaline, making them less corrosive than acid baths, and are essentially non-toxic. Copper pyrophosphate dissolved in potassium pyrophosphate forms a stable complex ion from which copper plates. Potassium is generally used instead of sodium because it is more soluble and has a higher electrical conductivity. The pyrophosphate copper plating bath generally includes nitrate to increase the maximum allowable current density and reduce cathode polarization. Ammonium ions may be added to the bath to produce more uniform deposits and to improve anode corrosion, and oxalate may be added to the bath as a buffer.

The copper electroplated coating on the zinc or zinc alloy article is carried out by standard electroplating techniques. Preferably the zinc alloy articles, especially for coinage, may be provided with a copper deposit by electroplating the articles in a barrel plating apparatus.

Barrel plating is suitably used for plating many small articles at one time. Parts in a workload are tumbled in a cascading action by a rotating vessel or "barrel" immersed in a plating bath. Long work pieces and entangling parts can be coated using barrel plating if long barrels, longitudinal and radial compartments, rocking motion, or special stationary contacts are used.

The barrel plating apparatus generally includes a non-conducting perforated container or barrel in which the zinc alloy cores are contained. The container is positioned in a bath of plating solution and, during the electroplating operation, the container is moved angularly about a horizontal axis with an anode being located in the plating solution outside the container and a cathode contacting the zinc alloy cores being located with the container. The electroplating is continued until the copper cladding reaches a desired thickness on the surface of the zinc or zinc alloy article.

The process of the present invention forms a firmly adherent copper coating on a zinc or zinc alloy article, which can be deformed without any loss of the copper coating. Penny blanks coated by the process of the present invention are evenly covered with a firmly adherent copper coating. This process provides a less toxic alternative to more traditional plating of penny blanks in a cyanide copper plating solution.

The foregoing description is provided by way of illustration only. Although the invention has been described with reference to particular features and embodiments, it will be understood that these are not intended as limitations of the scope of the invention, as defined in the appended claims.

What is claimed is:

1. A process for copper plating a zinc or zinc alloy article comprising the steps of:

a. immersing said zinc or zinc alloy article in an aqueous alkaline nickel solution to form an adherent continuous nickel coating on a surface of said zinc or zinc alloy article, said aqueous alkaline nickel solution comprising a source of nickel, a source of pyrophosphate, and a source of hydroxide; and thereafter b. electroplating said nickel-coated zinc or zinc alloy article in a copper pyrophosphate solution to form an adherent copper coating on said nickel-coated zinc or zinc alloy article, wherein said copper pyrophosphate solution does not contain cyanide.

2. A process according to claim 1, wherein said source of nickel is selected from the group consisting of nickel sulfamate, nickel sulfate, and nickel chloride.

3. A process according to claim 1, wherein said source of nickel is present in said aqueous alkaline nickel solution at a concentration of about 6 to about 20 grams/liter.

4. A process according to claim 1, wherein said source of pyrophosphate is selected from the group consisting of potassium pyrophosphate, sodium pyrophosphate, and ammonium pyrophosphate.

5. A process according to claim 1, wherein said source of pyrophosphate is present in said aqueous alkaline nickel solution at a concentration of about 30 to about 60 grams/liter.

6. A process according to claim 1, wherein said source of hydroxide is selected from the group consisting of ammonium hydroxide, sodium hydroxide, and potassium hydroxide.

7. A process according to claim 6, wherein said source of hydroxide is sufficient to raise the pH of the solution to between 9 and 10.

8. A process according to claim 1, wherein said aqueous nickel solution is maintained at a temperature between room temperature and 80° C.

9. A process according to claim 1, wherein said zinc or zinc alloy article is immersed in said aqueous nickel solution for a period of about 2 to about 20 minutes.

10. A process according to claim 1, wherein said zinc or zinc alloy article is a penny blank, and said penny blank is electroplated with said copper pyrophosphate solution in a bulk plating barrel.

11. A process according to claim 1, wherein said adherent copper coating on said nickel-coated zinc or zinc alloy article can be deformed without any loss of copper coating material.

12. A process according to claim 1, wherein said zinc alloy article contains 2 percent copper.

13. A process according to claim 12, wherein said zinc alloy article is a penny blank.

14. A process for copper plating a zinc or zinc alloy article comprising the steps of:

a. forming an adherent continuous nickel coating on a surface of the zinc or zinc alloy article by immersing said zinc or zinc alloy article in an aqueous alkaline nickel solution, said aqueous alkaline nickel solution comprising:

i) a source of nickel selected from the group consisting of nickel sulfamate, nickel sulfate, nickel pyrophosphate, and nickel chloride, ii) a source of pyrophosphate selected from the group consisting of potassium pyrophosphate, sodium pyrophosphate, and ammonium pyrophosphate, iii) a source of hydroxide selected from the group consisting of ammonium hydroxide, sodium hydroxide, and potassium hydroxide; and b. electroplating said zinc or zinc alloy article in a copper pyrophosphate solution to form an adherent copper coating on said nickel-coated zinc or zinc alloy article, wherein said copper electroplating solution does not contain cyanide.

15. A process according to claim 14, wherein said source of nickel is present in said aqueous alkaline nickel solution at a concentration of about 6 to about 20 grains/liter.

16. A process according to claim 14, wherein said source of pyrophosphate is present in said aqueous alkaline nickel solution at a concentration of about 30 to about 60 grams/liter.

17. A process according to claim 14, wherein said source of hydroxide is sufficient to raise the pH of the solution to between 9 and 10.

18. A process according to claim 14, wherein said aqueous nickel solution is maintained at a temperature between room temperature and 80° C.

19. A process according to claim 14, wherein said zinc or zinc alloy article is immersed in said aqueous nickel solution for a period of about 2 to about 20 minutes.

20. A process according to claim 14, wherein said adherent copper coating on said nickel-coated zinc or zinc alloy article can be deformed without any loss of the copper coating material.

21. A process according to claim 14, wherein said zinc alloy article contains 2 percent copper.

22. A process according to claim 21, wherein said zinc alloy article is a penny blank, and said penny blank is electroplated with said copper pyrophosphate solution in a bulk-plating barrel.

* * * * *

UNITED STATES PATENT AND TRADEMARK OFFICE

CERTIFICATE OF CORRECTION

PATENT NO. : 6,827,834 B2
DATED : December 7, 2004
INVENTOR(S) : Ronald Stewart et al.

It is certified that error appears in the above-identified patent and that said Letters Patent is hereby corrected as shown below:

Column 6,
Line 5, between "about 20" and "liter" delete "grains" and replace it with -- grams --

Signed and Sealed this

Nineteenth Day of April, 2005

JON W. DUDAS
*Director of the United States Patent and Trademark Office*